US006562282B1

(12) United States Patent
Arseneau et al.

(10) Patent No.: US 6,562,282 B1
(45) Date of Patent: May 13, 2003

(54) METHOD OF MELT BLOWING POLYMER FILAMENTS THROUGH ALTERNATING SLOTS

(75) Inventors: Warren Arseneau, Burlington (CA); Gord W. Johnston, Toronto (CA)

(73) Assignee: Rtica, Inc., Stoney Creek (CA)

( * ) Notice: Subject to any disclaimer, the term of this patent is extended or adjusted under 35 U.S.C. 154(b) by 212 days.

(21) Appl. No.: 09/621,892

(22) Filed: Jul. 20, 2000

(51) Int. Cl.[7] ..... D01D 5/098; D01D 5/14; D02G 3/02; D04H 3/00

(52) U.S. Cl. ..... 264/555; 264/103; 264/210.8; 264/211.14

(58) Field of Search ..... 264/103, 210.8, 264/211.14, 555

(56) References Cited

U.S. PATENT DOCUMENTS

| | | | | |
|---|---|---|---|---|
| 2,510,135 A | | 6/1950 | Pedlow et al. | |
| 3,825,380 A | | 7/1974 | Harding et al. | |
| 3,981,350 A | | 9/1976 | Page | |
| 4,135,903 A | | 1/1979 | Ohsato et al. | |
| 4,803,117 A | * | 2/1989 | Daponte | 442/329 |
| 4,818,464 A | | 4/1989 | Lau | |
| 4,986,743 A | | 1/1991 | Buehning | |
| 5,248,247 A | | 9/1993 | Rubhausen et al. | |
| 5,260,003 A | * | 11/1993 | Nyssen et al. | 264/6 |
| 5,292,239 A | | 3/1994 | Zeldin et al. | |
| 5,580,581 A | | 12/1996 | Buehning | |
| 5,582,905 A | | 12/1996 | Beck et al. | |

* cited by examiner

*Primary Examiner*—Leo B. Tentoni
(74) *Attorney, Agent, or Firm*—Davis & Bujold, P.L.L.C.

(57) ABSTRACT

A melt blowing die for extruding filaments of a polymer by a suitable configured air supply system to provide critical influencing and control over the molecular orientation, crystallinity and crystal orientation in high speed fiber spin line applications. Control of the both the magnitude and location of the applied shearing force is provided, through the design characteristics of the air supply system and, in particular, the attenuation of the filament through an attenuation slot; in one form in conjunction with the introduction of the air flow to the filament in a parallel flow caused by a Coanda bend in a second form in conjunction with a properly designed internal channel.

9 Claims, 3 Drawing Sheets

METHOD OF MELT BLOWING POLYMER FILAMENTS THROUGH ALTERNATING SLOTS

FIELD OF THE INVENTION

This invention relates to a melt blowing die apparatus for spinning filaments of molten synthetic fiber material to produce fibrous non-woven thermal insulating mats constructed of thermoplastic fibers and particularly, though not exclusively, to form high loft batts of linear condensation polymers, preferably polyester, for example, polyethylene terephthalate (PET). The mats may be thermally insulating mats in the form of mats, boards or batts with an insulating R value of at least 3.5/inch and preferably at least 4/inch. Specifically, the invention relates to control of the drawn filament by a flow of pressurized air flow parallel to the extruded filaments to provide attenuation of the filaments within an attenuation slot provided in a lower portion of the apparatus.

BACKGROUND OF THE INVENTION

It has been proposed to produce polyester (e.g. PET) non-woven insulating mats, constructed by melt-blowing techniques, having R values of 4.0 or more per inch with mats using substantially continuous fibers of 3–12 microns. However, mass production of high-loft batts suitable for the insulation of building structures have not, in the past, proved economical in spite of extensive research efforts devoted to producing such environmentally friendly products.

PET non-woven fiber mats, specifically for insulating purposes, whether commercial or domestic, have been proposed using melt blowing die equipment in which melted PET is extruded through a plurality of nozzles to form substantially continuous fibers which are then carried by a high velocity gas toward a fiber mat forming location, at which the fibers are laid down with self entanglement, resulting from the highly turbulent accelerating gas flow, to produce the desired batt integrity. It is proposed in the art to produce such insulating batts (and boards) via one or more arrays of nozzles disposed in a straight line arranged over the mat forming location to progressively produce the desired batt configuration as it is conveyed under the array(s). As the fibers are extruded by the nozzles, they are collected on a collection device, in a layer of fibers to form the insulating mats, batts or boards.

U.S. Pat. No. 5,248,247 discloses an aligned nozzle configuration, two slot ducts producing air jets directed to intersect, at an acute angle, the spin line below the nozzle carrying die face (or near it). The role of the air jets is to cause the extruded polymer filaments to be stretched and expose the fibers to turbulent air flow and preferably broken up prior to deposition in a random mass on the moving belt below the die. The main thrust of the patent is directed at the provision of a uniform driving pressure along the entire lateral die length for the air supply system feeding the slot nozzles. It is postulated, in this prior art, that even small variations, along the die length, in this total driving pressure applied to the slot air flow will lead to an unacceptable non-woven product/mat.

Other components of the meltblowing die are elongate plates referred to as air knives (nozzle bars), which form an accelerating air flow channel to, in combination with the die tip nose piece, form converging air flows to attenuate and draw down the extruded fibers to microsized diameters. The air knives are generally elongate plates which have a longitudinal edge tapered to form a knife edge. Two air knives are typically used and are fastened to the face of the die body on opposite sides of the triangular die tip nose piece. The tapered edges of the air knives are aligned with the confronting tapered surfaces of the nose piece and spaced slightly therefrom to form two flow channels which converge at the apex of the nose piece.

The spatial relationship between the air knives and the die tip is defined in the art by parameters known as air-gap and set-back. The air-gap and set-back determine the geometry of the converging air flow passages, and thereby control the airflow properties and the degree of fiber-air interaction.

The prior art melt blowing apparatus as disclosed in U.S. Pat. No. 5,248,247 for production of melt blown filament line is shown generally in FIG. 1 as comprising an extruder 1, melt blowing die 4 and a collector drum or conveyor belt 12. The extruder 1 delivers molten resin through an aligned evenly spaced series of nozzles 6 in the die 4, where, upon exiting the nozzles 6, an aligned evenly spaced plurality of filaments (fibers) 2 are extruded to be attenuated and passed down through tapered slits, in a lower portion of the apparatus onto the conveyor belt 12, by pressurized, converging hot air streams. The tapered slit 11 is formed by adjacent parallel relatively thin nozzle bars 5 through which the combined air/fiber stream passes. The filaments 2 are then collected on the belt 12 to form a mat or fleece of insulation F.

The melt blowing apparatus also includes a source of pressurized air 3 communicating with the die 4 through valved lines 8 and heating elements 7 in order to produce the converging hot air streams 9. Additionally, baffles and air pressure regulating devices 10 are provided together with the heating elements 7 and valved lines 8 to control the conditioned hot air streams 9.

As is known to those in the art, the extruder 1 includes an interior cavity where PET chips or similar polymer material are pressurized, heated and melted to produce the molten PET resin. The extruder 1 is provided with the aligned evenly spaced plurality of nozzles 6 communicating with the cavity. The nozzles 6 are supplied with molten PET under pressure to form an aligned evenly spaced plurality of filaments 2 at a desired flow rate.

In conjunction with the molten resin flow, the hot air streams 9 are provided from the pressurized air source 3 via the valved lines 8 into confluence with the filament line 2 substantially adjacent the nozzle 6. The hot air streams 9 are directed by an outlet oriented so as to introduce each of the air streams into the slit 11 at an acute angle to the direction of the flow of the filaments 2, thereby attenuating and drawing the filaments 2 downwards towards the conveyor belt 12 as illustrated in FIG. 1.

The slit 11 does not provide parallel flow controlling walls and is formed by the relative thin nozzle bars in which the slot forming walls converge throughout the vertical height of the slot and thereby fail to provide a controlled flow of the air, passing therethrough, parallel to the filaments and thus do not provide adequate control of filament attenuation and temperature. Here no mention of controlling the temperature of the slot walls is made.

OBJECTS OF THE INVENTION

It is an object of the present invention to provide an improved melt blowing apparatus and method to more effectively control the properties of attenuated filaments formed thereby.

The main objective of the invention is to provide an attenuating air flow in a vertical direction, parallel to the exiting filament direction so that appropriate shearing forces may be applied to the extruded filaments in the attenuating channel. This objective is achieved by means of a small radius Coanda bend or by a suitably designed channel flow, immediately upstream from the entrance to the attenuating channel.

Another object of the invention is to provide adequate fiber entanglement below the die face and the exit plane of the slot discharge, by means of the highly turbulent flow field and the free air entrainment existing in this region.

SUMMARY OF THE INVENTION

Shearing forces applied to an extruding filament of molten synthetic fiber material (polymer) by a suitably configured air/gas flow system provide an important means of influencing and controlling the molecular orientation, crystallinity and crystal orientation in certain high speed fiber spin line applications. The control of both the magnitude and location of the applied shearing forces, through the design characteristics of the air/gas system, is crucial to the achievement of improved and optimized mechanical properties of the resulting drawn fibers.

In contrast to the above described prior art, the present invention provides an accelerating high velocity fiber attenuating air flow in a vertical, attenuating slot extending along the fiber length as it is extruded. At the entrance section of this slot, along the fiber center line, the extruded filaments move vertically downward with a relatively low velocity. In this slot surrounding these filaments is provided an accelerating parallel high velocity air flow, with a maximum velocity approximately two orders of magnitude greater than the emerging filament velocity. The air flow is supplied by two identical, mirror image, ducting systems symmetrically disposed one on either side of the die nozzle center line, with each incorporating a rapid turning section immediately upstream of the slot entrance, so that the air flow enters the attenuating channel flows in a substantially vertical (downward) direction. In the attenuating slot, shearing and attenuating forces and temperature quenching are applied to the extruded molten filaments. The final product's physical properties are critically dependent on the magnitude and time/space histories of the shearing and temperature quenching applied.

At the exit of the attenuating slot, the air discharge from the attenuating slot emerges as a free turbulent jet quickly acquiring high turbulent energy levels. In particular, large lateral turbulent velocity components are developed due to free air entrainment. The latter contribute significantly to the entanglement of the now rapidly solidifying or solidified filaments collected below the slot exit plane.

An important element of the present invention relates to the supply of suitably conditioned attenuating air flow to the extruded (polymer) filaments. To develop the necessary shear forces at the air flow/polymer interface, the air flow must be delivered to the spun filaments (fibers) in a substantially vertical direction (i.e. parallel to the length of the filaments), at a point as close to the exit of the extruded filament from the nozzles as possible. The air flow must execute a very tight turn, approaching 90°, to arrive at the vertical direction at or near the top of the spin line, after traversing an approximately horizontal path across the die extruding components (die nozzles) by which the filaments are extruded. A Coanda bend in the air supply is a preferred means of achieving this separation free flow turning.

Two identical air flow channels symmetrically converge on the die center line at the top of the spin line, on either side of the extruded filaments. The converged air flows from the systems, together with the extruded filaments, enter an attenuating slot, where the main shearing forces and temperature quenching are applied to the molten filaments. The degree of temperature quenching is controlled by the temperature difference maintained between the extruded fluid filament, at the die exit, and the conditioned attenuating air supply used.

Two alternative attenuating air supply systems are described to meet the major design objectives/requirements of the present invention. These objectives are:

- The mean air flow velocity must be increased significantly to a high subsonic value at the downstream delivery location at the top of the spin line. The outlet/inlet velocity ratio required in the air system is on the order of 10:1 to 20:1 with the exact value dependent upon the required filament shearing forces and the drawing/attenuation needed in the final product.
- The air flow must be turned to a substantially vertical discharge direction, by means of a small radius of curvature turn, at or immediately above the flow discharge into the attenuating slot.
- The rapid turning and acceleration of the mean air flow in the system must be achieved without the introduction of any adverse flow pressure gradients on the walls defining the flow passages in the air supply system.
- The delivered high velocity air flow at the top of the spin line must be uniform, along the length of the die, and uniformly across the inlet to the attenuating slot.

In the first of the general design approaches, FIG. 2 reveals a suitably configured and curved, fully attached internal flow channel to deliver the necessary air to the spin line. The air flow channel has a general "S" shaped center line contour, with the first, low speed turn directing the air flow entering (approximately vertical) across the bottom of the high pressure polymer nozzle assembly towards the spin line. The second, high speed turning in the "S" channel orients the discharge flow into the vertical spin line direction with a small radius bend. The air flow acceleration in the channel is such that high accelerations are applied in the low-velocity sections of the channel, including the first, low speed, turn, while small and vanishing accelerations are applied in the high-velocity sections including the second, high speed, turn. The final high speed turn must be carried out using a relatively small radius bend in order to permit the application of air shearing forces vertically at or near the top of the spin line. The entering air in the supply system is at a low velocity determined by the supply ducting and the blower/fan/compressor used to produce the necessary supply of air pressure and volumetric capacity of the die system. The air supply system also includes a suitable air heating unit to provide appropriate control of the temperature in the drawing/attenuating processes in and below the attenuating slot section. The final air discharge velocity from the supply system will typically be in the Mach No. range between 0.50 and 0.75 (400–800 f.p.s.) although wider limits are not precluded.

In the second of the general design approaches, for the air supply system (FIG. 4) the second turn described above which turns the air flow to the vertical spin line direction, is replaced by a short, approximately horizontal, wall jet section and a two-dimensional Coanda bend of approximately 90°. The curved free surfaces of the wall jet and the Coanda bend are vented to atmospheric pressure, as shown, through a suitable ducting arrangement. These free Coanda surfaces located symmetrically on both sides of the spin line entrain a significant volume of vented air prior to the convergence of the wall jets at the top of the spin line, at the entrance to the final attenuating channel section. On either side of the spin line trapped and standing vortices may be maintained above the curved free jet surfaces. Recirculation into the flow volume containing the trapped vortices must be terminated by a suitable wall contour design, prior to the convergence of the two Coanda wall jets at the entrance to the attenuating channel section. Coanda wall turns provide excellent flow turning properties when properly designed and vented. With turning radius to jet thickness ratios in the region 4–6, total turning angles of greater than 130° can be achieved without wall separation.

Acceleration rates of the air/gas flow in the discharge channel are set at levels appropriate to the desired axial strains to be applied to the attenuating fiber filaments. The necessary flow accelerations are provided through appropriate area and geometry variations incorporated into the discharge nozzle design.

Additional control of the drawn filament properties in the drawing scheme described, can be obtained by adjusting and controlling the temperature difference between the extruded polymer filament and the quenching air/gas flow utilized.

In certain applications, it may prove advantageous to provide the necessary gas/air flow turning into the spin line direction, turning this flow into the spin line direction, by combining a Coanda bend section with a suitably curved fully attached channel flow section. Thus the total required flow deflection would be achieved in separate, but connected, channel sections.

A Coanda jet is a term applied to a class of jet flows having the following features: i) a thin wall jet flow discharging over a straight or an arbitrarily curved wall surface, and in continuous contact with this surface, at one edge (side), so that entrainment at this edge is entirely eliminated; ii) the remaining (outer) jet edge is exposed to a constant pressure region when large free air entrainment occurs.

The feature of Coanda jet flows that is particularly attractive for present design purposes is the relatively very tight wall curvatures that can be negotiated without the expected separation of the jet flow from the wall surface. The wall jet may be either laminar or turbulent, however, for present applications a laminar flow is preferred.

The most important inventive aspect of this submission would appear to be as follows: i) provision for an abrupt turn and acceleration of the attenuating air flow into the spin line direction, without wall separation to accomplish the required turning flow and ii) the application of the major attenuating forces to the filaments internally in an attenuating slot. The magnitude and axial variation of the magnitude of the applied shear forces are controlled by the design of the channel section and the temperature of the supplied attenuating air flow. In particular the axial variation of the channel flow area is an important design consideration. For the formation of non-woven mats from PET the following parameters of the present invention are typical:

Extrusion die head temperature of 500/700° F.

Filament Velocity—exiting the polymer nozzle of about 0.1 to about and exiting the die slot with a velocity in the range of about 20 to about 200 feet per second. Large variations in both of these are to be expected, with a factor of plus/minus, three/four quite probable (both depend on the die design objectives).

Air Flow Velocity—exiting the polymer nozzle≈400/800 f.p.s. Again large variations can be expected (design dependent) with an upper (sonic) limit of approximately 1200/1400 f.p.s.

Filament Diameter Attenuation ratio 10:1 to 100:1.

Original Typical Filament Diameter of about 0.01–0.02 inch.

Attenuating Slot Width/Height
width—0.10–0.50 inch
height—0.25–2.50 inches

Die clearance above Table—2 to 20 ft. typical.

Temperature of Attenuating Air (Die Entrance)~500/700° F., typical.

Temperature of Entrained Air from ambient~+50°.

Dies—heated~400/700° F., typical.

Two general design approaches for the air supply system required are sketched in FIGS. 2 and 4. FIG. 2 configuration does not incorporate the Coanda effect of FIG. 4 to achieve the required flow turning. In FIG. 2, turning is accomplished via duct wall design, with the polymer exterior surface providing the inner duct wall profile. The air flow in the case, is smoothly and rapidly accelerated, through a large area contraction (10:1) by means of cubic wall profiles, and simultaneously turned into the spin line at the base of the polymer nozzle. A very accurately controlled wall profile is required throughout the length of the die, to avoid air flow separation in the resulting "S" shaped nozzle.

According to the invention there is provided a melt blowing die apparatus, for extruding a plurality of polymer filaments for the manufacture of non-woven thermally insulating polymer mats, comprising: a) a die having a downwardly facing die face, defining a plurality of polymer filament extruding nozzles having axes directed to extrude the filaments vertically downwardly; b) a slot defined by vertical opposed parallel side walls evenly spaced on opposite sides of the axes, through which the filaments, extruded by the die through the nozzles, pass; and c) a pair of air supply channels located adjacent the downwardly facing die face, one on either side of the axes, each for the supply of a hot air stream vertically downwardly to and through the slot on opposite sides of said axes in contact with the filaments to attenuate the filaments passing vertically downwardly through the slot thereby to produce attenuated filaments to form the mats subsequent to downward exit from the slot.

Also according to the invention there is provided a method of melt blowing polymer filaments, for the manufacture of non-woven thermally insulating polymer mats, comprising the steps of: a) extruding a plurality of polymer filaments downwardly; b) passing the filaments centrally through a slot, having vertical parallel slot defining side walls, common to all the filaments; c) providing heated air streams on opposite sides of the filaments, to flow vertically with the filaments through the slot to attenuate the filaments while in the slot and below to produce attenuated filaments for the formation of the mats.

BRIEF DESCRIPTION OF THE DRAWINGS

The invention will now be described, by way of example, with reference to the accompanying drawings, in which.

DESCRIPTION OF THE PREFERRED EMBODIMENTS

Figure 1:
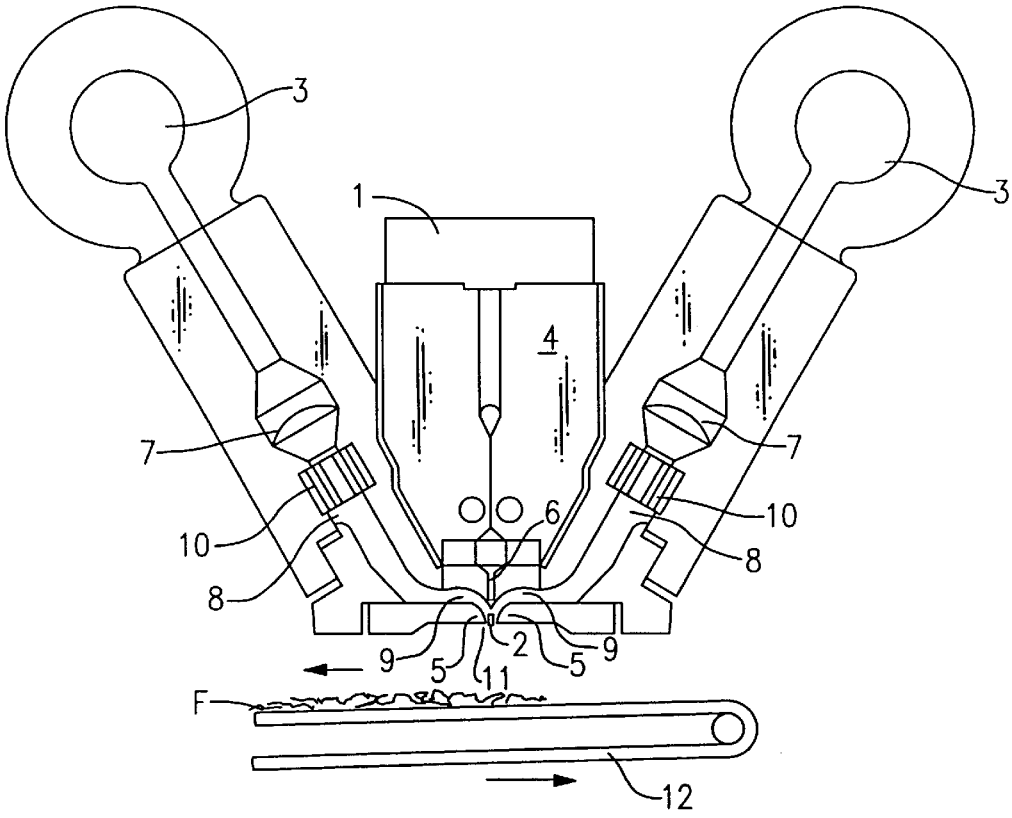
FIG.1 Prior Art
FIG. 1 is a diagrammatic elevation of a melt blowing apparatus according to the prior art.
Figure 2:
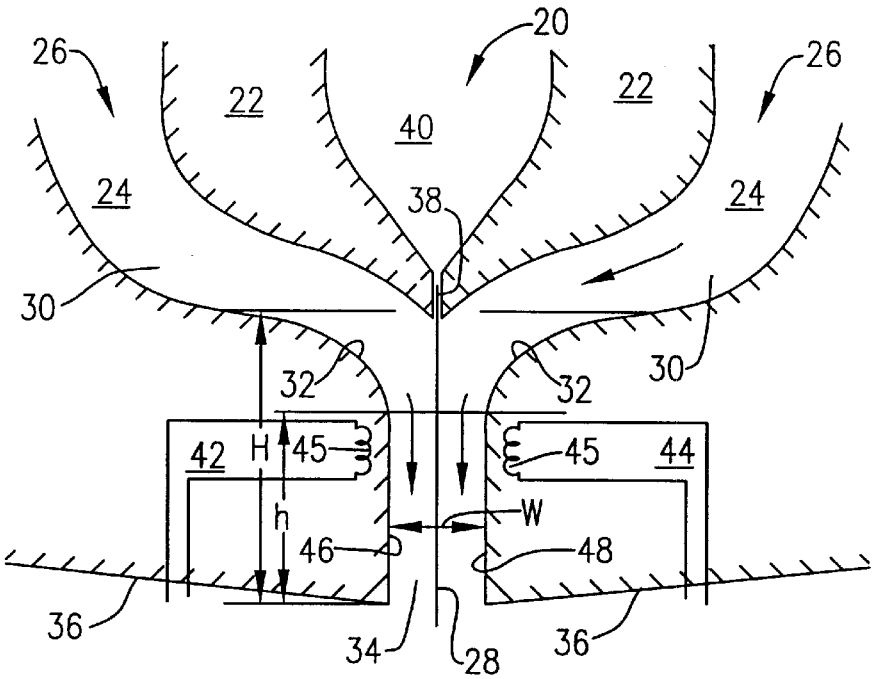
FIG. 2 is a partial cross-section of the nozzle and nozzle bar defining an attenuating slot according to the present invention.
Figure 3:
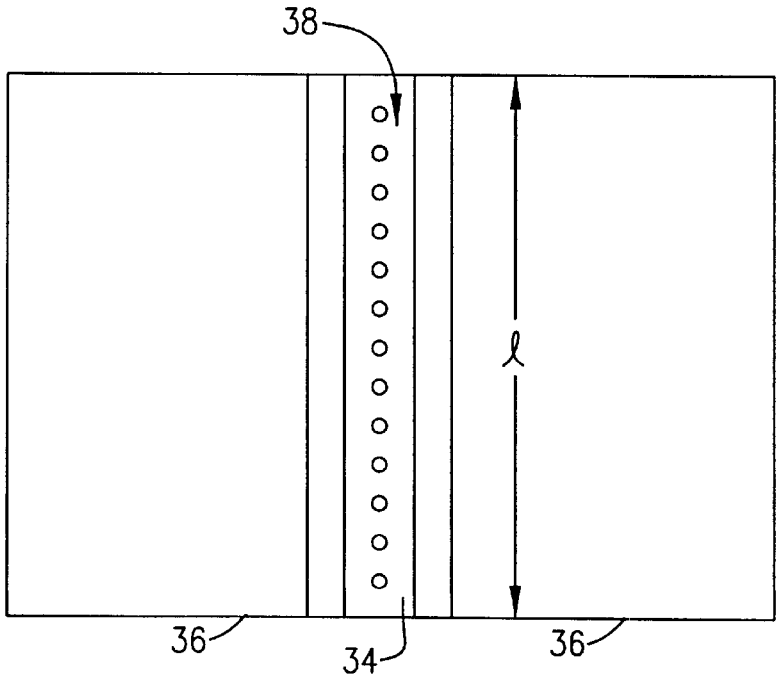
FIG. 3 is a simplified diagrammatic underview of the apparatus of FIG. 2.

Referring to FIGS. 2 and 3, a first embodiment of the present invention will be described. The melt blowing apparatus 20 includes a nozzle bar 36 which in conjunction with the polymer die 22 defines a suitably configured and curved, fully attached air flow channel 24. The flow channel 24 delivers a hot air stream 26 to an extruded spin line of filaments 28. The flow channel 24 has a generally "S" shaped contour, with the relatively large radius turn 30 directing the stream 26 across the bottom of the die 22 towards the filaments 28. A relatively small radius turn 32 in the air flow channel 24 orients the hot air stream 26 to flow substantially parallel to the vertical direction of movement of the filaments 28 in a slot 34. The temperature of the attenuating air stream 12 as it reaches the filaments 28 is typically from about 500 to about 700° F., and the walls of the slot are heated in a range of about 400° F. to about 700° F.

The air stream in the channel 24 are such that high accelerations take place in the large radius turn 30, while smaller accelerations occur in the high-velocity occurring in the small radius turn 32. The final turning of the hot air stream 26 is carried out by the relatively small radius bend 32 at the entry of the slot 34 in the nozzle bar 36 in order to obtain the desired application of air shearing forces at or near the top of the filaments 28 adjacent to the uniformly spaced array of filament extruding nozzles 38 of the die 22.

The air entering the flow channel 24 from a pressurized air supply source is at a low velocity determined by the supply ducting and the blower/fan/compressor used to produce the necessary supply of air and volumetric capacity of the air supply system. The air supply system includes an air heating unit to provide appropriate control of the temperature in the drawing/attenuating processes in and below the attenuating slot 34. The air discharge to the slot 34 from the air flow channel 24 is typically in the Mach number range between 0.50 and 0.75 although wider limits are not precluded.

The nozzle bar 36 also defines the attenuating slot 34 through which the filaments 28, downwardly extruded by nozzles 38, are drawn downwardly by the attenuating air flow. The attenuating slot 34 has a length (FIG. 3) extending laterally of the filaments symmetrically along either side of the serial plurality of nozzles 38 to provide a symmetrical consistent attenuating air flow to each of the plurality of filaments.

The major attenuating forces comprise both axial and shear forces applied to the filaments by the air flow. These forces are generated and controlled internally in the attenuating slot 34. The axial attenuation of the filaments 28 is dependent upon the magnitude of the forces applied to the filaments 28 in the slot 34 and these forces are controlled by the configuration of the flow channel 24 and the attenuating slot 34, in particular the axial velocity distribution and the axial temperature distribution in the parallel air therethrough.

The nozzle bar 36 and attenuating slot 34 are formed from a first and second lower nozzle plates 42, 44 having a parallel first and second die faces 46, 48 defining the slot 34 and symmetrically disposed on opposite sides of the filaments 28. The nozzle plates 42, 44 are provided with heater coils 45 to provide desired temperature control in the slot 34. The first and second die faces 46, 48 are spaced from one another to define the attenuating slot width W in the range of about 0.100 to about 0.50 inch. The height H of the attenuating slot, which is generally in the range of about 0.250 to about 2.50 inches, includes the height h of the parallel first and second die faces 46, 48 of the attenuating slot 34 which are generally in the range of about 0.18 inches to about 2.0 inches.

From the extruder apparatus 2, molten polymer 40 is forced downwardly through the nozzles 38 to form the filaments 28, having a diameter, as they leave the nozzle, in the range of about 0.01 to 0.02 inch. The attenuating forces, both axial and shear, generated by the attenuating air flow 26 in the attenuating slot 34 to attenuate the diameter of the filaments 28 in a range of at least approximately 50:1 before the filament exits the attenuating slot 34 to be gathered on a collection belt.

As will be seen in FIG. 2, the lower face of the die 22 closely adjacent opposite sides of the row of nozzles 38 has a concave form which, together with the corresponding curves in nozzle plates 42, 44 form the small radius turns 32.

Figure 4:
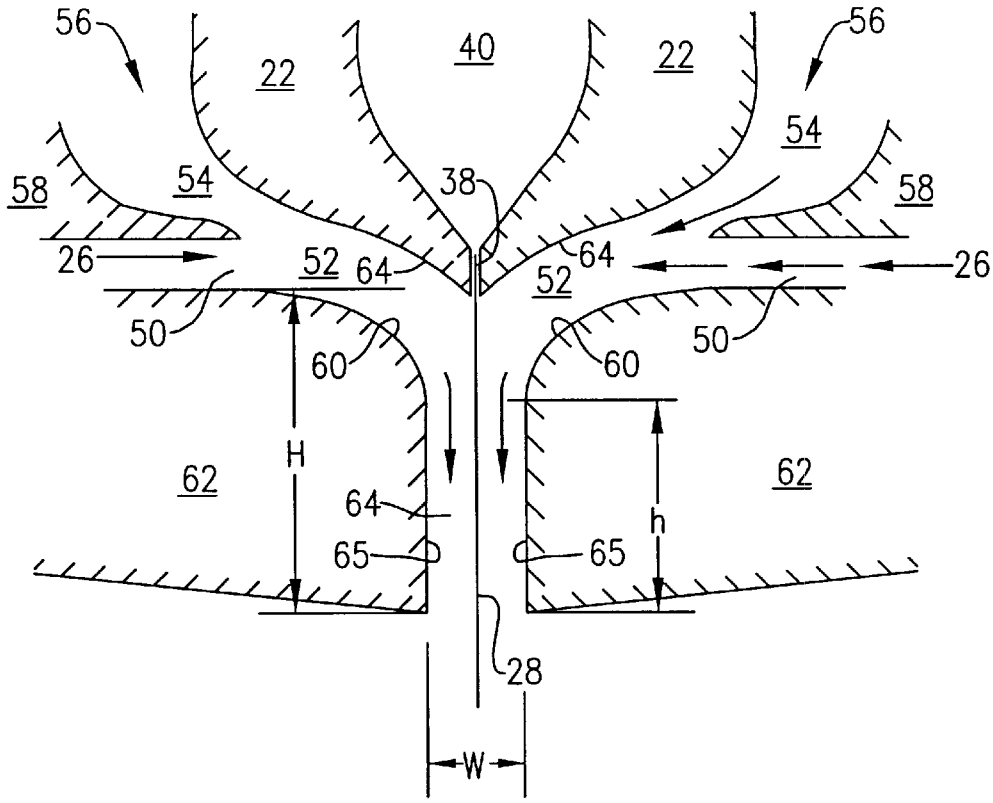
FIG. 4 is a partial cross-section of the nozzle and nozzle bar defining a Coanda bend and attenuating slot according to the present invention.

Turning now to FIG. 4, a second embodiment of the present invention is described. Here, each second turn 32 described above, for turning of the air stream 26 to flow in the vertical filament line direction, is replaced by a short, approximately horizontal, wall jet section and duct 50 and a Coanda bend 52 of approximately 90° having an associated duct 54 open to atmospheric pressure of the environment. The duct 54 provides a supply of air 56 to become entrained in a hot air stream supplied by duct 50 to produce the desired Coanda effect of air flow around the curved free surfaces of the Coanda bend 52.

The duct 56 is separated from the wall jet section and duct 50 by an intermediate bar 58 which provides for the separate introduction of the air 56 from the duct 54 and the pressurized air stream 26 from duct 50, to the entrance to the Coanda bend 52, in the form of a thin walled jet flow emanating from the duct 50. The thin walled jet flow exiting from the horizontal section wall jet section and duct 50 has an upper boundary which is exposed to the constant pressure via the ducting arrangement 54 from which free jet entrainment occurs. A lower boundary of the thin walled jet flow discharging from the duct over the curved free surfaces 60 of the Coanda bend 52 by the Coanda effect is caused to remain in continuous contact with the lower curved free surface 60 in order to obtain the desired turning of the pressurized hot air stream 26 around the small radius turn of the Coanda bend 52 into alignment with the filament line direction of movement. The temperature of the entrained air is generally ambient air at a temperature of about 50° F. or more.

The free Coanda surfaces 60 are located symmetrically on opposite sides of the extruded filaments 28. On either side of the nozzles, trapped and standing vortices may be maintained above the curved free jet surfaces. Recirculation into the flow volume containing the trapped vortices must be terminated by a suitable wall contour design, prior to the convergence of the two Coanda wall jets at the entrance to the attenuating slot 64.

Coanda bends provide excellent flow turning properties when properly designed and vented. With turning radius to jet thickness ratios in the region 4~6:1 total turning angles of greater than 130° can be achieved without wall separation.

Nozzle bars 62 which define the free surfaces 60 together form attenuating slot 64 through which the filaments 28 are drawn down by the attenuating air flow. The attenuating slot 64 has a length extending symmetrically along either side of the plurality of nozzles 38 to provide a symmetrical consistent attenuating air flow to each of the plurality of filaments.

The major attenuating forces comprise both axial and shear forces applied to the filaments by the air flow. These forces are generated and controlled internally in the attenuating slot 64. The axial variation of the filaments 28 is dependent upon the magnitude of the shear forces applied to the filaments and these forces are readily controlled by the configuration of the duct 50 and the attenuating slot 64, in particular the width W and height H of the attenuating slot 64, together with the form of the Coanda bend 52.

The attenuating slot 64 is formed by parallel faces 65 of nozzle bars 62 which faces 65 smoothly transitioning from the outlet ends of the Coanda bends 52. The faces define the slot width W in the range of about 0.10 inch to about 0.50 inch. The height H of the faces 65 define the height H of the attenuating slot 64, which is in the range of about 0.25 inch to about 2.5 inches.

From the extruder 2, the molten polymer 40 is extruded through the nozzles 38 forming the filaments 28, having a diameter, as they leave the nozzle, in the range of about 0.01 to 0.02 inch. The attenuating forces, both axial and shear, generated by the attenuating air flow applied to the filaments 28 within the attenuating slot 64 attenuate the diameter of the filaments 28 at least in a range of approximately 50:1 before the filament exits the attenuating slot 64 and is gathered on a collection belt 10.

Molten polymer is supplied at a suitably elevated temperature, to the nozzles 38, and filaments 28 are discharged uniformly, vertically downward by a suitable pressurized supply system. Air/gas streams are introduced laterally from both sides. These gas streams are deflected into the spin line direction by means of two-dimensional Coanda bends (90°, as shown). The curved free jet surface, at the outer edge of the Coanda bend, entrains and accelerates the individual cylindrical filaments 28 discharged vertically above it. Once the air/gas streams are deflected into a direction parallel to the filaments' downward movement, the flow provides further important axial acceleration to the fluid filaments as the streams merge to form a single vertical discharge to atmosphere at the lower die face. This latter acceleration is attributable to the large axial shear forces applied to the attenuating fluid elements in the discharge slot. The applied shearing forces are a result of the large axial velocity difference maintained between the filaments and the air/gas stream. (The mean axial air/gas velocity in the discharge channel is approximately two orders of magnitude larger than the initial discharge velocity of the fluid filaments.)

Acceleration rates of the air/gas flow in the discharge channel are set at levels appropriate to the desired axial strains to be applied to the attenuating fiber filaments. The necessary flow accelerations are readily provided through appropriate area and geometry variations incorporated into the discharge nozzle design.

Additional control of the drawn filament properties in the drawing scheme described, can be obtained by adjusting and controlling the temperature difference between the extruded polymer filament and the quenching air/gas flow utilized.

In certain applications, it may prove advantageous to provide the necessary gas/air flow direction, turning this flow into the spin line direction, by combining a Coanda bend section with a suitably curved fully attached channel flow section. Thus the total required flow deflection would be achieved in separate, but connected, channel sections.

The air flow through the slot is preferably lamina, however, the possible use of turbulent flow in the slot is not excluded from the concept of the present invention.

The air leaving the slot is or becomes rapidly turbulent with large turbulent energy levels which applies important lateral forces to the emerging attenuated filaments to facilitate the desired entwinement of the fibers to produce the non-woven mats, batts or boards constructed upon collection of the filaments on the belt 10.

| Reference numerals |
|---|
| 1 extruder |
| 2 filaments |
| 3 source of air |
| 4 die |
| 5 nozzle bars |
| 6 nozzles |
| 7 heating elements |
| 8 valved lines |
| 9 hot air streams |
| 10 baffles |
| 11 slit |
| 12 belt |
| 20 melt flowing apparatus |
| 22 die |
| 24 air flow channel |
| 26 hot air stream |
| 28 filaments |
| 30 large radius turn |
| 32 small radius turn |
| 34 slot |
| 36 nozzle bar |
| 38 extruding nozzles |
| 40 molten polymer |
| 42 nozzle plate |
| 44 nozzle plate |
| 45 heating coils |
| 46 die face |
| 48 die face |
| 50 duct |
| 52 Coanda bend |
| 54 associated duct |
| 56 air |
| 58 intermediate bar |
| 60 free surface |
| 62 nozzle bars |
| 64 slot |
| 65 parallel faces |

What is claimed is:

1. A method of melt blowing polymer filaments, for the manufacture of non-woven thermally insulating polymer mats, comprising the steps of:

a) extruding a plurality of polymer filaments downwardly;

b) passing the filaments centrally through a slot, having vertical parallel slot defining side walls, common to all the filaments;

c) providing heated air streams on opposite sides of the filaments, to flow vertically with the filaments through the slot to attenuate the filaments while in the slot to produce attenuated filaments for the formation of the mats subsequent to exit from the slot; and d) directing the heated air streams to flow vertically through the slot by the use of Coanda bend.

2. A method of melt blowing polymer filaments, for the manufacture of non-woven thermally insulating polymer mats, comprising the steps of:

a) extruding a plurality of polymer filaments downwardly;

b) passing the filaments centrally through a slot, having vertical parallel slot defining side walls, common to all the filaments;

c) providing heated air streams on opposite sides of the filaments, to flow vertically with the filaments through the slot to attenuate the filaments while in the slot to produce attenuated filaments for the formation of the mats subsequent to exit from the slot; and d) providing a laminar flow of the air streams through the slot.

3. A method of melt blowing polymer filaments, for the manufacture of non-woven thermally insulating polymer mats, comprising the steps of:

a) extruding a plurality of polymer filaments downwardly;

b) passing the filaments centrally through a slot, having vertical parallel slot defining side walls, common to all the filaments;

c) providing heated air streams on opposite sides of the filaments, to flow vertically with the filaments through the slot to attenuate the filaments while in the slot to produce attenuated filaments for the formation of the mats subsequent to exit from the slot; and d) providing an airflow through the slot which becomes turbulent upon exit from said slot to impart large lateral accelerations to the filaments subsequent to the exit from the slot to facilitate the required fiber entanglement.

4. A method of melt blowing polymer filaments, for the manufacture of non-woven thermally insulating polymer mats, comprising the steps of:

a) extruding a plurality of polymer filaments downwardly;

b) passing the filaments centrally through a slot, having vertical parallel slot defining side walls, common to all the filaments;

c) providing heated air streams on opposite sides of the filaments, to flow vertically with the filaments through the slot to attenuate the filaments while in the slot to produce attenuated filaments for the formation of the mats subsequent to exit from the slot; and d) the height of the slot as defined by said side walls providing attenuation of the filaments by the air streams in the slot by at least 50:1.

5. A method of melt blowing polymer filaments, for the manufacture of non-woven thermally insulating polymer mats, comprising the steps of:

a) extruding a plurality of polymer filaments downwardly;

b) passing the filaments centrally through a slot, having vertical parallel slot defining side walls, common to all the filaments;

c) providing heated air streams on opposite sides of the filaments, to flow vertically with the filaments through the slot to attenuate the filaments while in the slot to produce attenuated filaments for the formation of the mats subsequent to exit from the slot; and d) supplying the air streams as the air streams contact the filaments, at a temperature of about 500° F. to about 700°F. and heating the slot side walls to a temperature of about 400° F. to about 700° F.

6. A method of melt blowing polymer filaments for manufacture of a non-woven thermally insulating polymer mat, the method comprising the steps of:

a) extruding a plurality of polymer filaments downwardly;

b) passing the plurality of polymer filaments centrally through a slot having vertical parallel slot defining side walls common to all of the plurality of polymer filaments;

c) providing heated air streams on opposite sides of the plurality of polymer filaments, to flow vertically with the plurality of polymer filaments through the slot and attenuate the plurality of polymer filaments while in the slot to produce a plurality of attenuated filaments for the formation of the polymer mat following exit from the slot;

d) utilizing heated air streams, on opposite sides of the plurality of polymer filaments, having a velocity at the exit from the slot in a range of between 400 and 800 feet per second; and e) providing a laminar flow for the heated air streams through the slot.

7. A method of melt blowing polymer filaments for manufacture of a non-woven thermally insulating polymer mat, the method comprising the steps of:

a) extruding a plurality of polymer filaments downwardly;

b) passing the plurality of polymer filaments centrally through a slot having vertical parallel slot defining side walls common to all of the plurality of polymer filaments;

c) providing heated air streams on opposite sides of the plurality of polymer filaments, to flow vertically with the plurality of polymer filaments through the slot and attenuate the plurality of polymer filaments while in the slot to produce a plurality of attenuated filaments for the formation of the polymer mat following exit from the slot; and d) utilizing heated air streams, on opposite sides of the plurality of polymer filaments, having a velocity at the exit from the slot in a range of between 400 and 800 feet per second; and e) providing the air streams, on opposite sides of the plurality of polymer filaments, with an outlet air velocity of the air streams forming a ratio on the order of 20:1 with respect to an inlet air velocity of the air streams.

8. The method of claim 7 further comprising the step of providing a laminar flow for the heated air streams through the slot.

9. The method of claim 8 further comprising the step of causing the plurality of attenuated filaments to have a filament diameter attenuation ratio of between 10:1 to 100:1.

* * * * *